US010400377B2

(12) United States Patent
Zattin et al.

(10) Patent No.: US 10,400,377 B2
(45) Date of Patent: Sep. 3, 2019

(54) METHOD FOR OPERATING A WASHING APPLIANCE AND WASHING APPLIANCE

(71) Applicant: Electrolux Appliances Aktiebolag, Stockholm (SE)

(72) Inventors: Andrea Zattin, Solesino (IT); Federico Del Maschio, Pordenone (IT); Elena Pesavento, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 140 days.

(21) Appl. No.: 15/384,552

(22) PCT Filed: Jun. 24, 2014

(86) PCT No.: PCT/EP2014/063237
§ 371 (c)(1),
(2) Date: Dec. 20, 2016

(87) PCT Pub. No.: WO2015/197108
PCT Pub. Date: Dec. 30, 2015

(65) Prior Publication Data

US 2018/0073177 A1 Mar. 15, 2018

(51) Int. Cl.
*D06F 33/02* (2006.01)
*D06F 35/00* (2006.01)
(Continued)

(52) U.S. Cl.
CPC ..... *D06F 33/02* (2013.01); *D06F 23/02* (2013.01); *D06F 35/006* (2013.01);
(Continued)

(58) Field of Classification Search
CPC ..... D06F 33/02; D06F 32/02; D06F 37/304; D06F 37/36; D06F 39/005; D06F 39/022;
(Continued)

(56) References Cited

U.S. PATENT DOCUMENTS 5,134,867 A 8/1992 Kiuchi et al.
5,233,718 A * 8/1993 Hardaway ..... D06F 35/006 68/23.5
(Continued)

FOREIGN PATENT DOCUMENTS

DE 19534431 A1 3/1997
DE 10145601 A1 10/2002
(Continued)

OTHER PUBLICATIONS

Machine translation of EP 1707663 A1 to Brandt Ind, Oct. 2006. (Year: 2006).*
(Continued)

*Primary Examiner* — Joseph L. Perrin
(74) *Attorney, Agent, or Firm* — RatnerPrestia

(57) ABSTRACT

A method for controlling a wash process in a washing appliance includes supplying a detergent in the washing appliance; detecting a type of detergent supplied; performing a wash cycle that ends with a washing liquor drain; and performing a rinsing cycle in accordance with the detected type of detergent. When the detected detergent is a powder detergent, water is introduced into the washing chamber for a first rinsing step. Between the washing liquor drain and the first rinsing step, laundry is tumbled in the washing chamber at at least one of a revolving speed lower than a minimum spinning speed so that no spinning is performed between said washing liquor drain and the first rinsing step, or for a time interval different from the corresponding time interval during which the laundry is tumbled in a rinsing cycle where a liquid or gel detergent is detected.

18 Claims, 8 Drawing Sheets

(51) Int. Cl.

| | |
|---|---|
| ***D06F 39/00*** | (2006.01) |
| ***D06F 39/02*** | (2006.01) |
| ***D06F 23/02*** | (2006.01) |
| ***D06F 37/30*** | (2006.01) |
| ***D06F 37/36*** | (2006.01) |
| ***D06F 39/08*** | (2006.01) |

(52) U.S. Cl.
CPC ..... *D06F 37/304* (2013.01); *D06F 37/36* (2013.01); *D06F 39/002* (2013.01); *D06F 39/004* (2013.01); *D06F 39/005* (2013.01); *D06F 39/02* (2013.01); *D06F 39/022* (2013.01); *D06F 39/026* (2013.01); *D06F 39/085* (2013.01); *D06F 2202/02* (2013.01); *D06F 2202/12* (2013.01); *D06F 2204/06* (2013.01); *D06F 2204/084* (2013.01); *D06F 2204/086* (2013.01); *D06F 2220/00* (2013.01)

(58) Field of Classification Search
CPC .... D06F 39/026; D06F 39/304; D06F 39/085; D06F 35/005; D06F 35/006; D06F 2202/02; D06F 2202/12; D06F 2204/06; D06F 2204/084; D06F 2204/086; D06F 2220/00
See application file for complete search history.

(56) References Cited

U.S. PATENT DOCUMENTS

| | | | | |
|---|---|---|---|---|
| 2010/0050345 | A1* | 3/2010 | Kim | D06F 35/006 8/159 |
| 2010/0095465 | A1 | 4/2010 | Kim et al. | |
| 2011/0047716 | A1* | 3/2011 | Cho | D06F 37/306 8/137 |
| 2012/0180534 | A1* | 7/2012 | Cho | D06F 35/006 68/18 R |

FOREIGN PATENT DOCUMENTS

| | | | |
|---|---|---|---|
| DE | 102012208618 | A1 | 11/2013 |
| EP | 0393311 | A1 | 10/1990 |
| EP | 1688529 | A1 | 8/2006 |
| EP | 1707663 | A1 | 10/2006 |
| EP | 2113599 | A1 | 11/2009 |
| EP | 2183423 | A1 | 5/2010 |
| EP | 2243416 | A1 | 10/2010 |
| JP | H07124374 | A | 5/1995 |
| JP | H08112484 | A | 5/1996 |
| JP | 2011200524 | A | 10/2011 |
| JP | 2014064791 | A | 4/2014 |

OTHER PUBLICATIONS

International Search Report in corresponding International Application No. PCT/EP2014/063237, dated Mar. 12, 2015.
Database WPI, Week 201169, Thomson Scientific, London, GB; AN 2011-M70965, XP002736410, =& JP 2011200525 A (Matsushita Denki Sangyo KK), Oct. 13, 2011, abstract, paragraphs [0015], [0039]-[0071]; figures.
International Search Report in corresponding International Application No. PCT/EP20141063215, dated Mar. 6, 2015.
International Search Report in corresponding International Application No. PCT/EP2014/063239, dated Feb. 25, 2015.

* cited by examiner

METHOD FOR OPERATING A WASHING APPLIANCE AND WASHING APPLIANCE

This application is a 371 of international Application No. PCT/EP2014/063237 filed Jun. 24, 2014, the entire contents of which are incorporated herein.

TECHNICAL FIELD

The present invention is relative to a method for operating a washing appliance, such as a washing machine or a washer-dryer, optimizing the wash process as a function of the type of detergent used. Moreover, the invention is relative to a washing appliance so realized in order to optimize the wash process as a function of the type of detergent used.

BACKGROUND

In the present application, with the term "washing appliance" a washing machine or a combined washer-dryer is meant.

Many types of detergents to be used in the washing appliances are available nowadays.

The detergents can be classified in different groups, depending on their physical state: there are detergents in powder form, detergents in liquid or gel form and detergents in tablet form. The detergent in tablets can be divided in two sub-groups: tablets realized by compressed powder, which can also be further sub-divided in 2-in-1 detergent tablets, 3-in-1 tablets, 5-in-1 tablets, etc., and tablets in liquid form where the liquid is enveloped in a plastic membrane which dissolves in water.

A wash process of laundry or goods as performed by a washing appliance can be split in two phases. The first one is the washing cycle, also called main wash, and the second is the rinse phase or rinsing cycle.

Main wash represent the portion of the wash process during which the detergent is introduced within the appliance together with water to form a washing liquor. In this way, soil and dirt is removed from laundry and stabilized in the washing liquor. The key parameters involved in main wash are: temperature, amount of water, mechanical action, detergent type/amount and duration. In order to provide best results in washing performances vs. water amount and energy consumption, one or more of these parameters are generally optimized.

The rinsing cycle aims to remove the residuals of soil and detergent coming from the main wash. In many appliances, the rinsing cycle is performed stepwise, e.g. generally two or three rinsing steps are performed. Each step is commonly characterized by a defined amount of water, duration, and mechanical action.

The wash process is also often terminated by a final spinning cycle. Additional spinning steps might be present between consecutive rinsing steps during the rinsing cycle.

The rinsing cycle has a relevant impact on wash process water consumption. It covers more than 65% of the water filled in overall wash process. The rinsing cycle impacts also on the wash process time duration. For example, depending on the selected program, it could cover from 20% to 50% of the total wash process duration.

Rinse quality plays an important role in the customer perception; in particular it is highly undesired to retrieve residual of scum in the laundry after the wash process, and the increasing presence of allergies among users requires an efficient rinsing.

According to the known art, in certain conditions, the appliance could add an extra rinsing step in order to improve rinse quality. This additional rinsing step can be selected by the appliance's user or done by the appliance automatically, for example under critical condition such as a detection of high level of foam or when the quality of the rinse has to be improved for allergy or skin sensitive issues.

EP 1707663 discloses a procedure, for use on an automatic washing machine or washer/drier taking 2-4 kg of washing and a quick- or slow-dissolving liquid or powdered detergent in block or loose form, which includes periodic measurement of the electrical conductivity of the rinsing water. The measured values are compared with pre-determined threshold levels, and the duration of the rinsing and spin cycles of the washing program are adjusted to ensure that the use of rinsing water and intermediate spin speeds are kept to a minimum.

SUMMARY OF SELECTED INVENTIVE ASPECT

Applicants have realized that, in order to adapt the rinsing cycle to the real needs of the users, and at the same time saving time and water, a monitoring of the type and/or the amount of detergent used during wash and rinsing cycles could be performed.

Applicants have thus optimized the rinsing cycle modifying the latter according to the type of detergent. Applicants have discovered that the above objects could be obtained, in case the detergent is a powder detergent, changing the rinsing cycle so that either it does not include any spinning phase, or the tumbling of the laundry during the rinsing cycle takes longer than the corresponding tumbling in a rinsing cycle where liquid or gel detergent is used.

According to a first aspect, the invention relates to a method for controlling a wash process in a washing appliance having a washing chamber to wash laundry, comprising:

- Supplying a detergent in said washing appliance;
- Detecting a type of detergent supplied;
- Performing a wash cycle, said wash cycle ending with a washing liquor drain;
- Performing a rinsing cycle;
- wherein, during said rinsing cycle, in case the type of said detected detergent is a powder detergent:
- After said washing liquor drain, introducing water into said washing chamber for a first rinsing step, and between said washing liquor drain and said first water intake tumbling laundry in said washing chamber at a revolving speed lower than a minimum spinning speed, which is the speed at which the laundry remain attached to an inner wall of said washing chamber, so that no spinning is performed between said washing liquor drain and said first water intake; Or wherein, during said rinsing cycle, in case the type of said detected detergent is a powder detergent:
  - tumbling said laundry for a time interval different from the corresponding time interval during which the laundry is tumbled in a rinsing cycle where a liquid or gel detergent is detected.

According to a second aspect, the invention relates to a washing appliance including:

- a washing chamber to wash laundry having an inner wall;
- a motor apt to rotate said washing chamber;
- a control unit apt to control a wash process, said wash process having a wash cycle ending with a washing liquor drain and a rinsing cycle including at least a step of rinse water intake into said washing chamber, of laundry present in said washing chamber;

a sensor capable of determining a type of detergent supplied in said washing chamber;

wherein said control unit is in communication with said sensor and said motor, in case said detergent is a powder detergent, it is apt to control said motor between said washing liquor drain and said first water intake so that the laundry in said washing chamber is tumbled at a revolving speed lower than a minimum spinning speed, which is the speed at which the laundry remain attached to said inner wall of said washing chamber, so that no spinning is performed between said washing liquor drain and said first water intake;

Or wherein, said control unit is in communication with said sensor and said motor, and, in case said detergent is a powder detergent, it is apt to control said motor during the rinsing cycle so that the laundry in said washing chamber is tumbled for a time interval different from the corresponding time interval during which the laundry is tumbled in a rinsing cycle where a liquid or gel detergent is detected.

The present invention is applicable to washing appliances, such as for example a washing machine, as well as a combined washer-dryer machine, apt to wash laundry in a washing process. The washing appliance generally includes a washing chamber where the laundry to be washed is introduced and then, after the wash process, removed. The washing chamber, such as a drum included in a tub, is apt to rotate around an axis. The axis can be a horizontal axis, a vertical axis or a tilted axis, in other words, the invention applies to both front loading or top loading washing appliances.

Additionally, also water is introduced in the washing chamber, for example from the water main, and, during the wash cycle, also a detergent is added to the water to form a washing liquor, as described in the following. The washing chamber can be rotated by a motor and it can have either an horizontal rotational axis, a vertical rotational axis or a tilted axis of rotation. The connections between motor and washing chamber so that the washing chamber is rotated are known in the art and not further detailed in the following.

Furthermore, the washing chamber defines an inner wall, which is in contact, at least for a portion, with the laundry introduced in the washing appliance.

In the washing appliance, a user can select a washing program among a plurality of possible available programs. The selection can be made preferably operating a control panel, for example by means of a push button, a touch screen, a rotating knob or any other suitable means apt to select a program from a given list. In a washing machine, such programs' list includes for example a delicate or woolen program, a cotton program, a quick-wash program, etc.

Alternatively, some washing appliances "decides" the best suitable program to be used by themselves depending on the introduced laundry, and the user may be required to input some additional information, such as the washing temperature, or number of rinsing cycles, etc. In a preferred embodiment of the invention, the washing appliance is fully automatic and selects the program automatically as soon as laundry has been introduced in the washing chamber.

In a different appliance's programming, the user is free to set any parameter of the washing of goods, no preset value being forced by the selection of a program.

The washing program therefore sets the parameters of the wash process which is controlled by a control unit present in the washing appliance.

The wash process includes in all programs a wash cycle and a rinsing cycle. Additional cycles might be present as well, such as a spinning cycle or a drying cycle.

The wash cycle can include a single wash step or a plurality of different wash steps, for example it may include a pre-wash step followed by a main wash. In addition or alternatively, the main wash can be also divided in different, wash steps, for example separated by draining steps.

The wash cycle is terminated by a washing liquor drain where the liquor formed by water detergent and dirt present in the laundry is drained outside the washing chamber, for example in the main sewage.

As well, the rinsing cycle can include a single rinsing step or a plurality of different rising steps. Each rinsing step preferably includes a draining phase, a water intake phase and a tumbling phase.

The water intake phase include a water introduction of "fresh" water, in other words clean water, for example from the water mains, used to rinse the laundry and remove all remains of dirt and detergent.

In particular, the rinsing cycle includes at least a rinsing step where fresh water is introduced into the washing chamber. This first rinsing step takes place after the washing liquor drain.

Depending on the program selected, the maximum temperature of the water inside the washing chamber can be automatically determined by the selection of the program itself, or the user is required to input the maximum temperature, selecting the same from a list of available temperatures for the selected program. In the first option, the user may be allowed to modify the water temperature proposed by the appliance for the selected program. In the second option, several temperatures may be available, such as for example in the cotton program, where the user, after having selected the cotton program itself, is generally asked to select the maximum water temperature among a list of temperatures such as 30°, 40°, 60°, 90° etc.

In any case, the user, before or after selecting the washing program and/or the washing temperature, introduces some detergent into the washing appliance, for example in a detergent drawer in case of a washing machine or washer-dryer. Alternatively, the user may introduce the detergent directly inside the washing chamber of the appliance.

In a different embodiment of the invention, the washing appliance automatically introduces the detergent during the washing cycle. For example, the washing appliance may include a detergent tank in which detergent is stored and when the washing program is selected, either automatically or by the user, it doses the proper amount of detergent to be used during such a program. The detergent can be supplied to the washing chamber for example by means of a dedicated pump. The detergent tank preferably includes an amount of detergent suitable for a plurality of washing programs.

The detergent is used during the washing cycle according to the selected washing program in order to properly wash the goods inserted into the washing chamber.

As already mentioned, detergents can be in powder, either loose or in tablets, or in liquid or gel form, also in this case either loose or in pods. However, other type of detergents could be put in the market in the near future having different components and performances.

It is to be understood that more than one detergent can be introduced inside either the detergent drawer or the detergent storage. For example, a detergent for the pre-wash phase can be supplied, a second detergent for the main wash and a softener can be added as well. The detergent which is considered in the present invention is the detergent of the main wash phase, where the highest temperature of the whole washing program is achieved (not in all programs a high temperature is achieved, the "cold programs" for example keep a constant temperature throughout the wash cycle and rinsing cycle). Moreover, other washing aids could be introduced during the wash process, besides the detergent, such as a softener, a bleach, etc.

The detergent's type can be identified either automatically, i.e. by the appliance itself, by means for example of suitable sensor(s), or by the user who can select the type of detergent introduced using for example a memorized detergents' list or any other selector or known means present in the appliance, such as in the front panel. In both cases, in the present context, it will be said that the detergent's type is detected by the appliance, either by the use of sensors or by "detecting" the selection of the user.

In case the detergent type is determined automatically by the washing appliance, any method can be used. For example, the detergent type can be detected using a conductivity sensor. Such a sensor can be placed inside the washing appliance, in the washing chamber, so as to be in contact with the washing liquor. It has been shown that different types of detergents dissolve in different time intervals (e.g. some types of detergents take longer to dissolve than others) and/or reach different threshold value of concentration. Thus, by detecting the evolution of the conductivity of the washing liquor where water and detergent have been added over time, it is possible to determine the type of detergent used. Alternatively, the sensor can be placed in a recirculation circuit for the water. Moreover, two different sensors can be used, one in the washing chamber and one in the recirculation circuit, or both sensors can be located in one of the two.

The analysis of the conductivity in order to determine the type of detergent used is for example described in EP 2243416, EP 1707663 or DE 10145601 and they can be applied in this invention.

Alternatively, a different method is described in EP 2183423, in which the turbidity of the washing liquid is taken into consideration. Also this method can be used in the present invention.

Turbidity sensors may be optical sensors positioned in a hydraulic path of the appliance and may measure the optical transmittance of the liquid medium at a certain wavelength. While generally a stable relationship exists between transmittance and turbidity for a specific type of particles, the quality of the turbidity measurements may be a limiting factor for the accuracy. A turbidity sensor may comprise a light source, such as a light-emitting diode (LED) or similar solid-state lighting device, and a light-sensitive element, such as a phototransistor. A portion of the light emitted by the light source can then be received by the light-sensitive element after passing through the liquid medium. By comparing the radiant intensity (radiated power per unit solid angle) of the emitted light and the radiant intensity I of the received light, it is possible to deduce the transmittance of the liquid medium.

The type of detergent, regardless whether it has been set by the user or determined by the appliance automatically, can be detected before, during or after the wash cycle. After the sensor or sensors have determined the type of detergent or have made the required measurements, the data regarding either the type of detergent or the measurements are sent to the control unit which either calculate the type of detergent from the measurements data received or acknowledge the type of detergent determined. Further, the control unit, on the basis of the received data, controls the wash process according to aspects of the invention.

According to aspects of the invention, the rinsing cycle is then optimized according to the type of detergent detected.

When the type of detergent has been determined, either manually (e.g. user's input) or automatically (e.g. the washing appliance includes a software and/or a sensor to determine the type of detergent used without any input from the user), it is checked whether the detergent type is of a liquid or gel type or of a powder type. This check is performed by the control unit.

If the detergent is of the liquid or gel type, then no action is required and the selected washing program proceed as standard, e.g. as memorized in a memory of the washing appliance, for example a memory accessible to the control unit.

If the detergent is of the powder type, either in tabs or loose, then a further action takes place by the appliance. According to the method of aspects of the invention, a choice between two alternatives is performed in order to optimize the rinsing cycle of the wash process. According to the first alternative, there is no spinning before the fresh water intake for the first rinsing step, i. e. the rotational velocity of the washing chamber remains always below a minimum velocity for spinning, so that—after the washing liquor drain and before the water 25 intake of the first rinsing only tumbling takes place. In other words, between the washing liquor drain and the water intake of the first rinsing, the laundry is always tumbled without spinning.

"Spinning" is defined as the portion of the wash process during which, due to the "high" rotational speed of the drum or washing chamber, the laundry sticks to the inner surface of the chamber itself. Therefore, the minimum spinning speed is a critical speed N where the centrifugal force and the force of gravity applied to the laundry are balanced, since the laundry is distributed on the inner surface of the drum. For example, this critical speed N (rpm) can be calculated with the following expression:

$$N \propto \sqrt{\frac{2g}{\pi^2 d}}$$

Provided, g: acceleration of gravity (cm/sec$^2$);

d: internal diameter of drum (cm)

The laundry substantially stands still at the critical speed and no shuffle is performed. At speed lower than the critical speed, tumbling is performed, i.e. the laundry does not remain attached at the inner surface of the drum but is shuffled up and down. At a rotational speed higher than the critical speed, spinning takes place and the laundry remains attached to the washing chamber's inner wall.

Spinning is commonly used during the rinsing cycle to obtain at good rinse quality in terms of water-soluble compounds extraction. Moreover, during rinsing, spinning plays an important role in water consumption vs. rinse quality.

However, Applicants have observed that use of high speed intermediate spinning during the rinsing cycle could be detrimental when powder detergent containing zeolites and/or high concentrations of particulate soil are introduced in the washing chamber.

Zeolites are commonly used in the formulation of powdered detergent as builder. Builder has the main function to remove Calcium (Ca2+) and Magnesium (Mg2+) ions from the water bath. These ions are the main responsible of the level of water hardness of the water and can reduce the cleaning power of the detergent. Zeolites are chemically classified as tridimensional Aluminosilicates. The presence of Aluminium in the Silicate crystal lattice creates negative charge. Negative charge stabilizes positive ions as sodium in the lattice. These sodium ions are exchangeable with Calcium and/or Magnesium. In this way the mechanism of water softening is delivered by simple exchanging of Calcium (or Magnesium) ions (retained in the lattice) with Sodium ions released in the softened water. Sodium ions are inactive vs. the cleaning power of detergent.

Amount of Zeolites in powdered detergent is roughly 20-40% w/w depending on the product formulation.

The common Zeolite used in detergent is Zeolites A. The general zeolites chemical formula is: Nax [(AlO2)x (SiO2) y] zH2O. Zeolites A formula is Na12 [(AlO2)12(SiO2)12] 27H2O. Zeolites are insoluble in water and the physical form is like small white sand. The structure of the particle is porous. This characteristic guarantees the access to the water and ions inside the particles and the exchange mechanisms.

Dimension of the particles are in the range of the few micron (micrometer) from 0.5 to 4 μm (particles average 3.5 μm).

Other type of zeolites are: Zeolites P, MAP (maximum Aluminium P), X, Y, HS. The differences among type are related to the ratio Al/Si present in the lattice. This ratio strongly influences the lattice structure and the exchange capability.

During the tumbling part of the rinse, particulate is suspended in the rinse liquor and partially drained in the drain phase. When spinning starts, the residual liquor and particulate suspended herein are propelled through textiles, which act as a "filter". At high spin speed, this particulate may be trapped deeper in the textile fibres. This implies that in subsequent phases of the rinsing cycle more time and water are necessary to swell the fibres for extracting the trapped particles.

The trapped particles might also enhance the risk of allergies and skin irritations diseases in the user wearing one or more pieces of the laundry which still keeps some particulate within the fibres. This is very important if children laundry has to be made, where the risk of allergy is to be in particular minimized.

In order to avoid those drawbacks, according to this embodiment of the invention, if liquid detergent is detected, the above problems are not present and therefore spinning takes place. In particular, spinning takes place between the drain of the water liquor and the first water intake for the first rinsing step. On the other hand, if powder detergent is detected, the spinning during a portion of the rinsing cycle, in particular the portion between the drain of the water liquor and the first water intake for the first rinsing step, is thus removed. Tumbling of the laundry is "as normal", but the spinning is avoided till the laundry is sufficiently rinsed.

As a second alternative of the method of the invention, still to optimize the rinsing cycle, in case a powder detergent has been detected, the laundry is tumbled for a time interval different from the corresponding time interval during which the laundry is tumbled in a rinsing cycle in which a liquid or gel detergent is detected.

Powder detergent and liquid detergent have different solubility and thus they dissolve in water in different times. Commonly, solubility of liquid detergent is better compared to the powder. Therefore, in this embodiment of the invention, the duration of the tumbling time to favour the releasing of the residuals from textiles is adapted to the specific type of detergent and it is different among detergents having different solubility.

In this way, the tumbling part of the rinsing cycle can be drastically reduced if a high solubility detergent is present, while the rinsing achieves optimal results also when a powder detergent is used.

Thus, according to aspects of the method of the invention, the tumbling time is adapted to the detergent's specifications.

The invention, according to the above described aspects, may include, alternatively or in combination, one of the following characteristics.

In a preferred embodiment, tumbling said laundry for a time interval different from the corresponding time interval during which the laundry is tumbled in a rinsing cycle where a liquid or gel detergent is detected includes tumbling said laundry for a time interval longer than the corresponding time interval during which the laundry is tumbled in a rinsing cycle where a liquid or gel detergent is detected.

As already mentioned, the liquid or gel detergent might have a higher solubility in water compared to powder detergent, and thus when liquid detergent is used, the laundry preferably is to be tumbled for less time, compared to the tumbling time needed when a powder detergent is used. Therefore, preferably when the powder detergent is used, longer tumbling is performed.

Preferably, the rinsing cycle includes tumbling said laundry for a time interval dependent on the amount of said detected detergent.

In an advantageous embodiment of the invention, the length of the tumbling during the rinsing cycle depends also on the amount of detergent which has been introduced inside the washing appliance. This is applicable both in case a liquid or gel detergent is detected and a powder detergent.

Advantageously, the method includes:

Terminating said wash process with a final spinning cycle after said rinsing cycle.

After the rinsing cycle, substantially no or very little detergent is still present in the laundry and therefore spinning can be performed regardless of the type of detergent which has been used during the wash cycle, because such a detergent is not present any more. Therefore, preferably, a final spinning cycle is present in order to remove as much water as possible whatever type of detergent has been detected in the appliance.

The presence of this spinning cycle depends, among others, on the type of washing program selected by the user. In addition, the length and speed of the spinning also depends on the washing program. For example, "hand-wash programs" include no or very little spinning, while cotton programs have generally a long and fast spinning.

Preferably, the method includes:

In case said detergent is a powder detergent, providing more than one rinsing step during said rinsing cycle.

In a preferred embodiment, the rinsing cycle is divided in one or more rinsing steps. The total number of rinsing steps may vary and depends—among others—for example on the detergent type and/or the weight of the laundry and/or the washing program selected by the user or automatically by the appliance. Each rinsing step preferably includes a draining phase, a water intake phase and a tumbling phase.

More preferably, in case said detergent is a powder detergent, and in case said rising cycle includes at least two rinsing steps, said first rinsing step including said first water intake and a first draining phase, and said second rinsing step including a second water intake and a second draining phase, the method includes:

Between said first water draining phase and said second water intake, tumbling laundry in said washing chamber always at a revolving speed lower than a minimum spinning speed, which is the speed at which the laundry remain attached to an inner wall of said washing chamber, so that no spinning is performed between said first water draining phase and said second water intake.

In this way, in each rinsing step, the water full of detergent is drained and at each subsequent step the amount of detergent in the rinsing liquor becomes less and less. Being still detergent possibly present in the rinsing water, in a preferred embodiment the spinning is avoided also between the draining and the intake of fresh water of subsequent rising steps of the rinse cycle of the washing program.

Even more preferably, in case said detergent is a powder detergent, and in case said rinsing cycle includes at least three rinsing steps, said third rinsing step including a third water intake and a third draining phase, the method includes:

Between said second water draining phase and said third water intake, tumbling laundry in said washing chamber always at a revolving speed lower than a minimum spinning speed, which is the speed at which the laundry remain attached to an inner wall of said washing chamber, so that no spinning is performed between said second water draining phase and said third water intake.

In this way, substantially for the whole rinsing cycle, in case of a powder detergent, no spinning is performed, with the preferred exception of a final spinning phase at the end of the rinsing cycle to drain most of the remaining water present in the laundry.

More preferably, in case said detergent is a powder detergent, the method comprises, during said rinsing cycle:

adding a further rinsing step in addition to the number of rinsing steps present in a rinsing cycle where a liquid or gel detergent is detected.

In case of a powder detergent, a further rinsing step is preferably added compared to the number of rinsing steps performed when a liquid or gel detergent is detected, to maintain an optimal rinse quality at the end of the washing process. Even more preferably, this further rinsing step is combined with the spinning removal, i.e. during the rinsing cycle only tumbling is performed when the detected detergent is a powder detergent and a further rinsing step is added: in this case the total water consumption during the rinsing cycle is only slightly greater than the standard rinsing cycle water consumption (for example in case of liquid or gel detergent). Indeed, after each rinsing step, less water filling is needed for the subsequent rinsing step, because removing the intermediate spinning causes more water to remain inside the washing chamber.

In an embodiment of the invention, tumbling said laundry for a time interval different from a corresponding time interval during which the laundry is tumbled in a rinsing cycle where a liquid or gel detergent is detected includes:

separating said rinsing cycle in different rinsing steps; and providing a spinning step between two consecutive rinsing steps.

Preferably, for certain powder detergents, it is still possible to perform spinning during the rinsing cycle without experiencing the above mentioned drawbacks because during the longer tumbling already most of the detergent has been removed and the drawbacks of spinning with powder detergent are minimized. Therefore, in this case, powder detergent and intermediate spinning can be combined during the rinsing cycle because the option of having a longer tumbling that in case of a liquid or gel detergent removes enough detergent from the laundry's fibres.

Advantageously, detecting the type of detergent introduced includes:

detecting the conductivity of a washing liquor during said washing phase; and/or detecting the turbidity of a washing liquor during said washing phase.

Preferably, the detergent's type is detected via a sensor, for example positioned within the washing chamber or in a recirculating conduit for the water in the appliance, which measures the conductivity and/or the turbidity of the washing liquor.

In a preferred embodiment, detecting the type of detergent introduced includes:

imputing by the user the type of detergent introduced.

The user can input the type of detergent introduced for example by means of a control panel, generally but not necessarily located in the front of the washing appliance. For example the type of detergent can be selected in the control panel of the washing appliance.

Preferably, detecting the type of detergent introduced includes:

determining whether said detergent introduced is a powder detergent, or a liquid or gel detergent, or a liquid pod detergent, or a powder tab detergent.

Preferably, the method of the invention is capable of differentiating among several types of detergents. In any case, detergents are always divided in two classes: the liquid or gel detergent (loose or in pods) and the powder detergent (loose or in tabs).

In a preferred embodiment, determining the type of said detergent includes:

measuring the conductivity of a washing liquid present in said washing chamber.

More preferably, measuring the conductivity of the washing liquid includes:

determining the rate of change in conductivity caused by dissolution of said detergent in said washing liquid.

Alternatively or in addition, determining the type of said detergent includes:

measuring the turbidity of a washing liquid present in said washing chamber.

More preferably, it includes:

determining the rate of change in turbidity caused by dissolution of said detergent in said washing liquid.

Preferably, a combination of a turbidity measurement and a conductivity measurement is performed. Preferably, determining the type of said detergent includes:

measuring the conductivity of a washing liquid present in said washing chamber (2); and measuring the turbidity of a washing liquid present in said washing chamber (2); and determining that said detergent is a liquid or gel detergent if said conductivity is below a conductivity threshold and said turbidity is below a turbidity threshold; or determining that said detergent is a powder detergent if said conductivity is above a conductivity threshold and said turbidity is above a turbidity threshold.

The detection of the type of detergent can be carried on during the preheating and/or the early stage of the main wash phase that is after it has completely dissolved in water. Physical parameters used for this kind of detection are turbidity (cloudiness, meant as expression of the amount of light that is scattered or absorbed by the liquid; turbidity can be considered as the opposite of optical transmittance, high transmittance means low turbidity) and conductivity (meant as resistive component of electrical impedance), used synergistically. Use of combined turbidity and conductivity provides quantitative and qualitative improvement of data quality/reliability/precision if compared to use of one of these two parameters alone, since electrochemical and optical analysis give complementary points of view of the phenomenon under investigation.

Applicant has found that accurate results are obtained using the following table:

TABLE 1

| Type of detergent | Conductivity | Turbidity |
|---|---|---|
| Liquid | LOW | LOW |
| Powder | HIGH | HIGH |

where "low" and "high" have the meaning of "below threshold" and "above threshold", in this case two threshold being present, a turbidity and a conductivity threshold.

Analysis for detergent type recognition proposed here is based on difference in conductivity and turbidity signals from measures on the two types of detergents dissolved in water. Applicant has noticed that, under some conditions, turbidimetric water analysis alone could not be enough for distinguishing liquid to powder detergent; as conductimetric analysis alone. On the other hand, combination of turbidity and conductivity signals do enable to distinguish detergent type uniquely.

According to an advantageous embodiment, the method includes, in case said detected detergent is a liquid or gel detergent:

separating said rinsing cycle in different rinsing steps; and providing a spinning step between two consecutive rinsing steps.

In case of a liquid detergent, the disadvantages above mentioned which render spinning detrimental when a powder detergent is used are not present, and thus spinning is preferably used also during the rinsing cycle.

In a preferred embodiment, the method includes:

setting the duration of said rinsing cycle on the basis of the weight of the laundry and/or a type of washing program selected by the user.

Not only the type of detergent may influence the proper length to be set of the rinsing cycle, but also other characteristics of the laundry, for example whether a heavy load has been introduced, so that more water and more rinsing time have also to be used, or the type of washing program which has been selected by the user. Indeed, washing programs like cotton at high temperature are used for particularly dirty clothes which may need extra rinsing. On the contrary, a delicate program may require less water. Preferably, the method includes, in case said detergent type cannot be detected, Setting said detergent type equal to powder detergent.

If the detergent type cannot be detected for any type of reason (sensor's failure, excess of soil or dirt or foam, etc.), the more "safe" solution is preferred, e.g. it is considered that the detergent is a powder detergent so that either the spinning between the washing liquor drain and the first water intake is avoided, or a different tumbling time takes place. In this way, the optimal rinsing performances are always achieved.

Preferably, said sensor is located within said washing chamber.

Alternatively or in addition, said washing appliance includes a recirculating water circuit and said sensor is located within said circuit.

The position of the sensor to determine the type of detergent is twofold. Alternatively, two sensors of two different types can be located within the appliance. Using two different sensors can improve the sensitivity of the whole system, allowing to detect different type of detergents with a high precision.

According to a preferred embodiment, said sensor is a conductivity sensor.

According to a different embodiment, or in addition to the previous one, said sensor is a turbidity sensor.

BRIEF DESCRIPTION OF THE DRAWINGS

Preferred embodiments of the present invention will be now described in greater details with reference to the attached drawings in which.

DETAILED DESCRIPTION OF A PREFERRED EMBODIMENT

Figure 1:
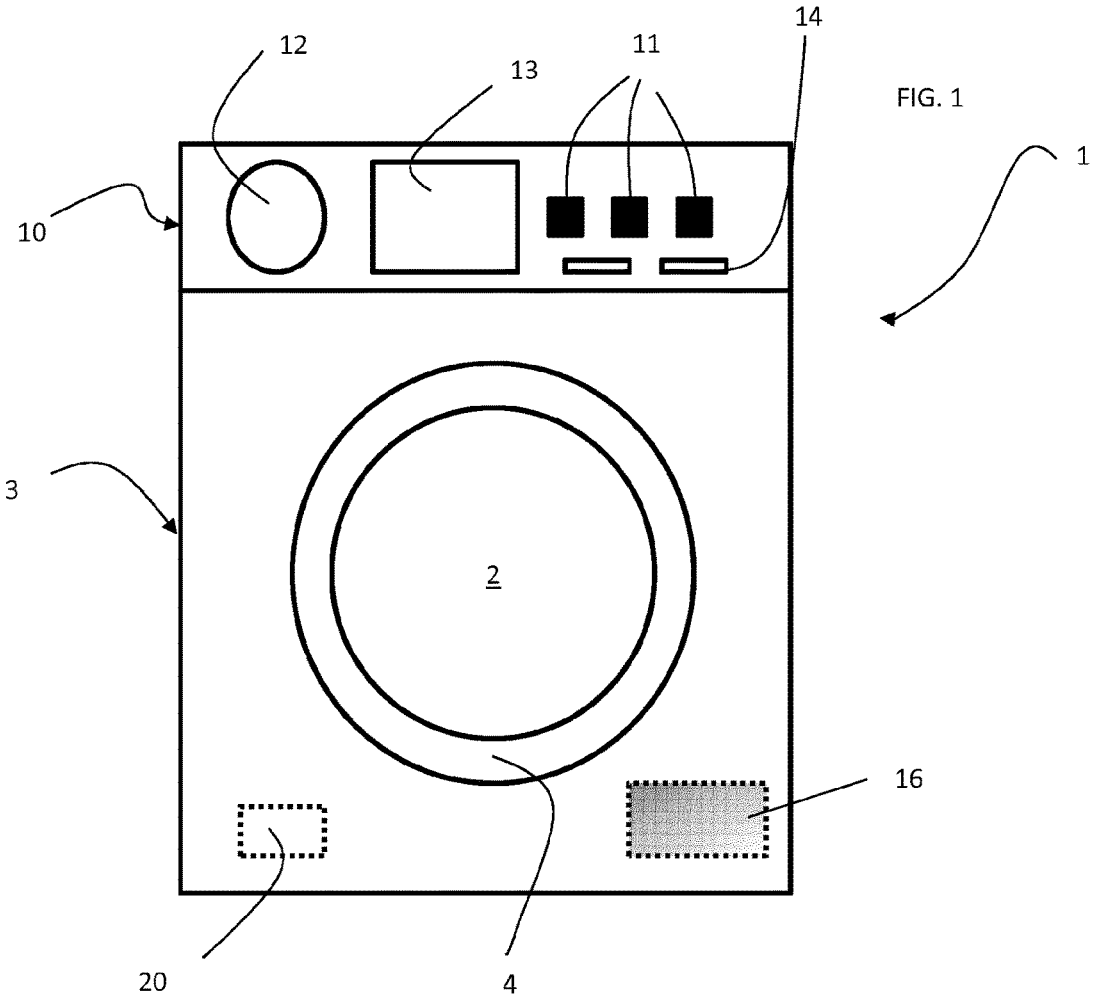
FIG. 1 is a schematic view of a washing appliance operating according to the method of aspects of the invention.

With initial reference to FIG. 1, a washing appliance operating according to the method of the invention is globally indicated with 1.

The washing appliance 1, depicted here as the preferred embodiment, not limiting the scope and applicability of the invention, is a washing machine. The machine 1 includes a washing chamber 2, where goods, in this case laundry, are placed and removed. Washing chamber 2 is preferably contained in a casing 3 having an aperture closed by a door 4 pivotably mounted on the casing 3. Washing chamber 2 is connected to a water reservoir, such as water mains, by means of a water inlet (not visible in the figures). Furthermore, washing chamber 2 is rotated by a motor (not shown in the appended drawings). Although the appended drawings show a washing machine of the front loading type, the present invention applies to top loading washing machines as well.

The washing machine 1 includes further a control panel 10 apt to be used by a user to set parameters of washing programs (e.g. temperature, number of rinsing cycles, speed of spinning, etc.) and/or to select a washing program from a given list, through suitable push buttons 11 or knobs 12. Moreover, control panel 10 includes preferably a display 13 and one or more light elements 14.

The washing machine 1 is preferably programmed to function according to the one or more washing programs.

These programs include for example a wool program, a cotton program, a delicate program, a synthetic program, a quick program, etc.

Each of these programs includes

A wash cycle and

A rinsing cycle.

Optionally, some of the programs might also include a final spinning cycle after the rinsing cycle. Optionally, in case of a washer-dryer, a drying phase is also present.

The control of these programs, and thus of the motor of the chamber 2, is performed by a control unit 16.

In some of the programs, the wash cycle is separated in different steps, being for example a pre-wash cycle (if needed) and a main wash. In some programs, the rinsing cycle is also separated in one or more rinsing steps. Consecutive rinsing steps are preferably separated by a draining step in which the rinse liquor is expelled from the machine 1, for example via a drain conduit (not visible in the figures).

Additionally, preferably but not necessarily, the washing machine 1 includes one or more sensor 20 to determine the type of detergent introduced inside the washing machine. Such sensor(s) can be for example turbidity sensor and/or conductivity sensor, etc., or any other sensor as long as it is suitable to determine the type of detergent introduced. Additionally, other sensor(s) can be present as well (not depicted in the drawings), for example a sensor to measure the weight of the laundry introduced into the washing machine 1 and/or a sensor to determine the amount of detergent introduced. With the term "sensor" also a software is meant, as long as it is capable of determining the required data.

Preferably, the sensor(s) 20 are apt to detect the type of detergent introduced among a set of detergent including a liquid or gel detergent, a compacted powder detergent (powder detergent in tablets), loose powder detergent, liquid pods (e.g. liquid detergent encapsulated in a plastic foil). Of course, only some or more detergent's type can be determined by the sensor(s) 20. In any case, sensor 20 is apt to determine whether the type of detergent is powder detergent or not.

Sensor 20 is in communication with the control unit 16 in order to send to the latter the results of the measurements performed.

With now reference to FIGS. 2*a*-2*b*, 3*a*-3*b* and 4, the method of the invention operates as follows.

The user inserts laundry inside the washing chamber 2 of the washing machine 1 (phase 22). One washing program, among the available washing programs, is selected by the user using the control panel 10. Moreover, additional parameters can be selected by the user as well (temperature of water, speed of the spinning phase, etc.). Alternatively, the program can be selected automatically by the appliance when the laundry has been loaded into the washing chamber. This is phase 23 of the method of the invention, common to all FIGS. 2*a*-3*b*.

The user inserts a detergent of a given type inside the washing appliance 1, for example in a detergent dispenser or drawer (not shown in the drawings). Alternatively, the user can insert the detergent inside the washing chamber directly. The detergent is then flushed from the drawer and then introduced within the washing chamber. Alternatively, the detergent can be supplied automatically by the appliance 1 itself as soon as the need of detergent is required during the washing program. In this case, the machine 1 includes a detergent tank (not depicted) in which the detergent is stored and, for example by means of a pump, is introduced in the washing chamber. The introduction of the detergent in the washing chamber can be made before or during the beginning of the washing program. This is phase 22 of the method of the invention, combined with the insertion of laundry. Upon activation of the "start" button, the washing machine operates, the selected washing program then starts, and the wash process begins. In a different embodiment, the washing process starts automatically, for example triggered by the closure of the door 4.

The order of these two phases 22, 23 can be interchanged without any technical difference.

At the beginning of the washing cycle, which could be during the main wash or in the pre-wash step if selected, of the selected washing program, the water inlet is opened and fresh water is inserted in the washing chamber 2. Detergent is also introduced, either flushed from the drawer or injected into the washing chamber directly from the tank of detergent (not depicted), as detailed above.

In order to determine the type of detergent introduced by the user, as required in step 24 of the method of the invention, either the user can select the type of detergent introduced, for example inputting this information via the control panel 10, or the appliance 1 does the recognition automatically by means of one or more sensors. In the latter case, for example a conductivity sensor (not shown) can be positioned inside the washing chamber 2. Alternatively, the conductivity sensor can be located in a recirculation water circuit of the washing appliance.

In the latter case, preferably, during the filling of the washing chamber 2 with fresh water, the conductivity of the fresh water can be measured so as to obtain a fresh water conductivity reference value, or alternatively a fresh water conductivity reference value may be preset in an operating program of the appliance 1.

After or during the introduction of fresh water into the washing chamber, as mentioned above, the detergent introduced by the user is also flushed into the washing chamber 2 or injected in the chamber by means of the pump connected to the detergent tank. After a given time, and preferably at given time intervals, the conductivity of the so obtained liquid (water and detergent mixture) is measured.

The conductivity so measured is compared with one or more thresholds and also preferably the time in which the measurements have been made it is taken into account. From the above mentioned comparisons and from the time in which the measurements have been taken, the detergent's type can be determined.

Figure 5:
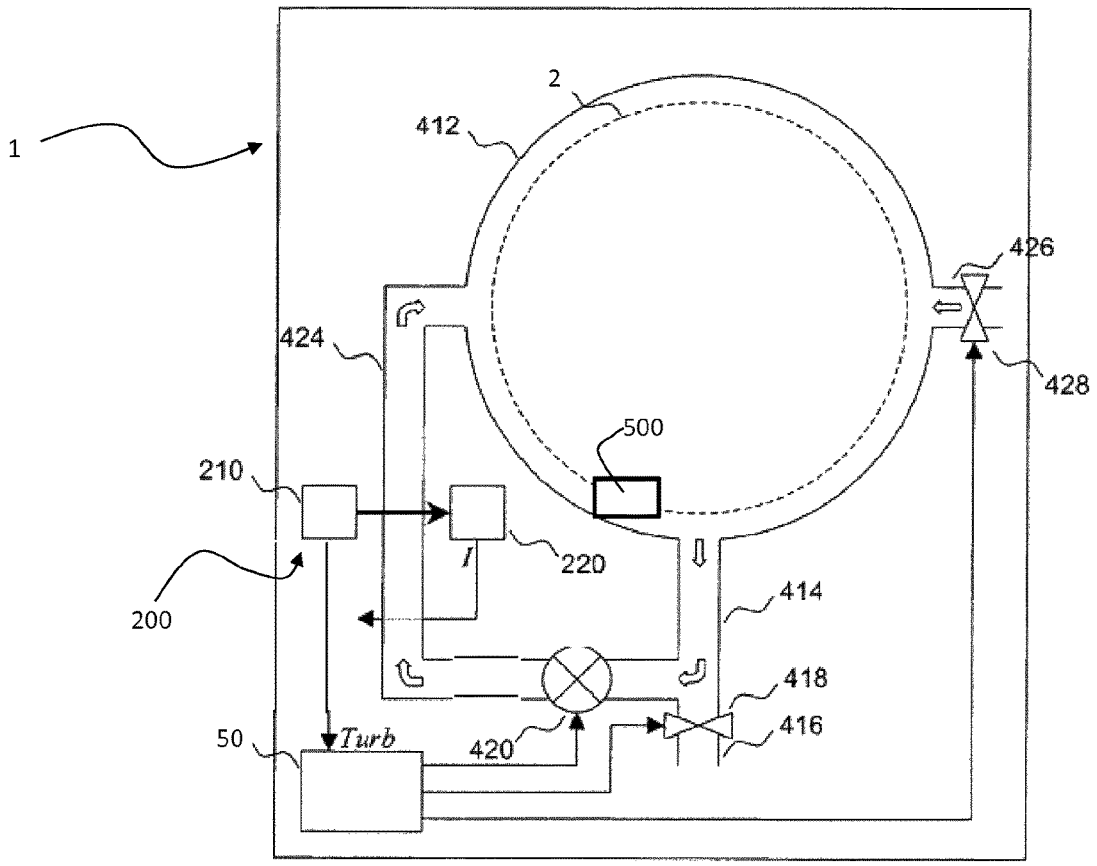
FIG. 5 is a schematic view of a washing appliance according to an embodiment of the invention.

In a different embodiment of the invention, depicted in FIG. 5, the sensor includes a turbidity sensor 200 and a sensor of conductivity 500.

The washing chamber 2 is suspended in a basin 412 having a downward first duct 414 connected to a drain 416 via a first valve 418. During operation of the machine 400, the basin 412 generally contains an amount of washing liquid and the first valve 418 is in the closed position. Washing liquid is fed via an inlet 426 by opening a second valve 428. A pump 420 is adapted to recirculate fluid exiting the basin 412 via a second duct 424. Means for influencing the course of the washing cycle, notably the valves 418, 428 and the pump 420, are controllable by the control unit 50. In this example, the sensor 200 is provided around the second duct 424 and provides a signal indicative of the turbidity to the control unit 50.

More precisely, the sensor 200 may include a light-emitting portion 210 and a light-receiving portion 220 is provided on one side and on the opposite side of the second duct 424.

After determining the turbidity of the fluid on the basis of the emitted and received intensities, the control unit 50 determines the type of detergent used.

Advantageously, the walls of the second duct 424 are transparent to the wavelength of the light emitted by the sensor 200, at least in a segment around the sensor 200. Alternatively, apertures may be provided in the second duct 424, so that the light-emitting 210 and light-receiving portions 220 of the sensor 200 make direct contact with the washing fluid.

Furthermore, washing machine 1 includes an additional sensor 500 located within the washing chamber 2, which measures the conductivity of the washing liquor as detailed above.

According to an embodiment of the invention, the two measurements are used in the following way in order to determine the type of detergent introduced in the washing chamber 2.

Figure 6A:
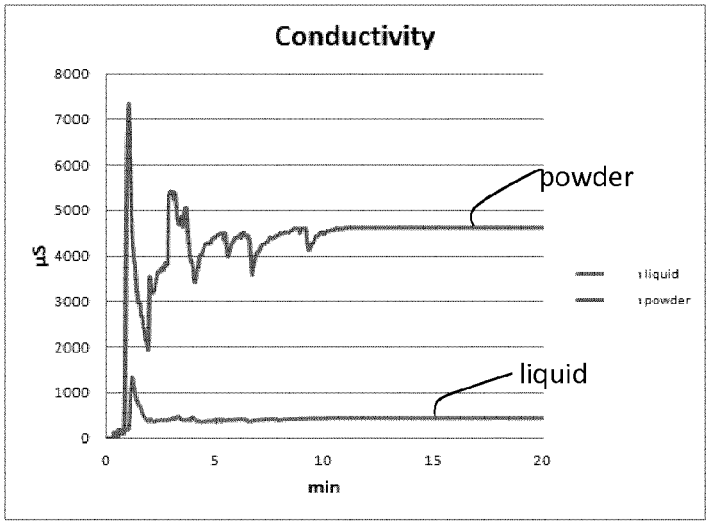
FIGS. 6*a* and 6*b* are two graphs of an embodiment of an optional phase of the method of the invention.
Figure 6B:
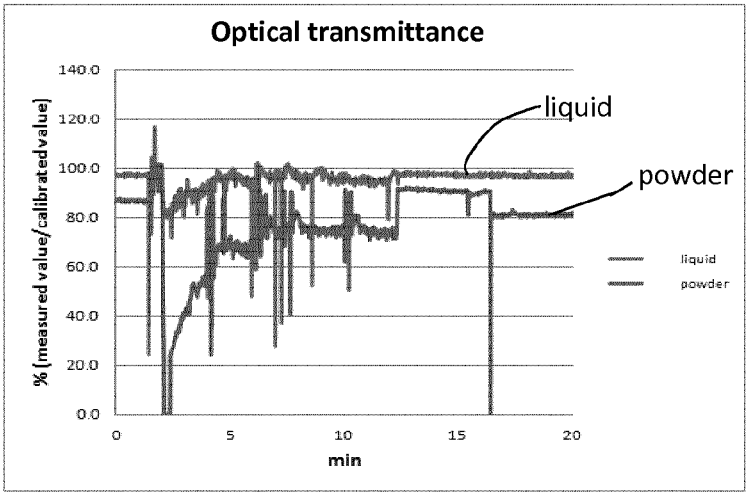

As visible in the graphs of FIGS. 6*a* and 6*b*, it is evident the large gap between signals when one or the other of the two type of detergents are used. In FIG. 5*a*, the upper curve is a plot of the conductivity versus time of a washing liquor with a powder detergent, while the lower curve is a plot of the conductivity versus time of a washing liquor with a liquid detergent. In FIG. 5*b*, the generally upper curve is a plot of the turbidity of a washing liquor with a liquid detergent, while the lower curve is a plot of the turbidity versus time of a washing liquor with a powder detergent.

FIG. 6*a* shows that powder detergent is characterized by higher conductivity, since there is almost a factor of 10 between the two signals. Experimental tests performed by the Applicant have shown that conductivity signals of powder and liquid detergent do not superimpose even when high liquid amount is compared to small powder amount, so making this kind of measurements robust and reliable.

Analogously, on FIG. 6*b* the percentage of transmitted light as measured by turbidity sensor 200 is plotted: powders cause greater water opaqueness, increasing light scattering and absorbance. So less light reaches the receiver 220 and lower output is given. In this case difference between two signals is less evident, but provides an additional parameter to be compared to conductivity in order to avoid mismatch or reading failure.

It is important to underline these values, both referring to conductivity and turbidity, are scarcely affected by the specific brand of detergent (that is, different brands show similar pattern).

Preferably, the conductivity is measured calculating a difference between conductivity of tap water (coming to the washing machine 1 via mains) and one of washing liquor (mainly, water and detergent dissolved therein) due to the fact that the conductivity of the water in the mains can change quite relevantly from one location to another. Therefore, conductivity of pure water is to be taken as zero-level in order to evaluate the role of detergent in determining conductivity itself. On following paragraph, the term "conductivity" is to be meant as "difference between two conductivities measured: with detergent and the one of mains water".

It is not necessary to compare washing liquor turbidity to tap water one, since it is reasonable that mains water is almost totally pure.

Since powder detergent cause low optical transmittance (i.e. high turbidity) and high conductivity; while liquid detergent cause low optical absorbance (i.e. low turbidity) and low conductivity, both conductivity and turbidity signal can be compared to a specific threshold defined ad hoc in order to distinguish the type of detergent. One possible implementation of the algorithm is shown by the table reported below:

TABLE 1

| Type of detergent | Conductivity | Optical Transmittance |
|---|---|---|
| Liquid | LOW | HIGH |
| Powder | HIGH | LOW |

where "low" and "high" have the meaning of "below threshold" and "above threshold".

Conductivity could be evaluated only on part of washing cycle, e.g. analyzing initial peak (clearly distinguishable at minute 1-2 on plot of FIG. 6*a*). This could be done in two different ways:

analyzing graph slope over 1-2 minutes after initial peak (that is, conductivity variation over time, whose absolute value is greater when dealing with powder detergent). For example, on said plot after initial peak powder conductivity changes from c.a. 7 mS to c.a. 2 mS in about 90 s (55 μS/s on average), while liquid one ranges on average only of c.a. 8 μS/s (from 1250 to 500 on 90 s). These orders of magnitude are scarcely dependent on the specific brand of detergent taken into account.

analyzing the maximum value of the peak, that is the point where difference between conductivities is maximum. For example, on said plot maximum value for powder detergent is above seven thousand, while liquid detergent gives a maximum conductivity between one and two thousands. These orders of magnitude are scarcely dependent on the specific brand of detergent taken into account.

Such differences on conductivity and turbidity signals between liquid and powder detergents are due to their composition. At first, powder detergents contain great amounts of fillers, builders and alkali: zeolites are one of main components which do increase turbidity; on the other hand, zeolites aren't part of liquid detergents' composition.

Carbonates, sulphates and silicates are responsible for high conductivity in powder.

Combined use of turbidity and conductivity sensors prevents the measurements to be affected by water pollution from load high soiling levels and/or load pigments dissolution in water. Using only one sensor (e.g. turbidimeter) could imply in some circumstances that high soiling levels may lead to misleading results: particulate dirt cause high turbidity levels, which may refer to powder detergent. Since particulate dirt scarcely affects conductibility, the presence of powder detergent is excluded and the final feedback could be liquid detergent plus high level of particulate soil. As above mentioned, such problem would be solved using the combination of two said sensors.

Similarly, loads heavily soiled with soluble dirt may cause water to get high conductivity levels, even if liquid detergent is used. In this case turbidimetric analysis is supposed to avoid detergent wrong recognition.

Therefore, according to the phase above described, the type of detergent either liquid or powder is determined automatically by the washing machine 1 using two sensors 20. The output of those sensors is sent to the control unit 50 which calculates, for example using a suitable software, the type of detergent present in the washing chamber. Any other method to determine the detergent's type can be used as well in phase 24.

Figure 2A:
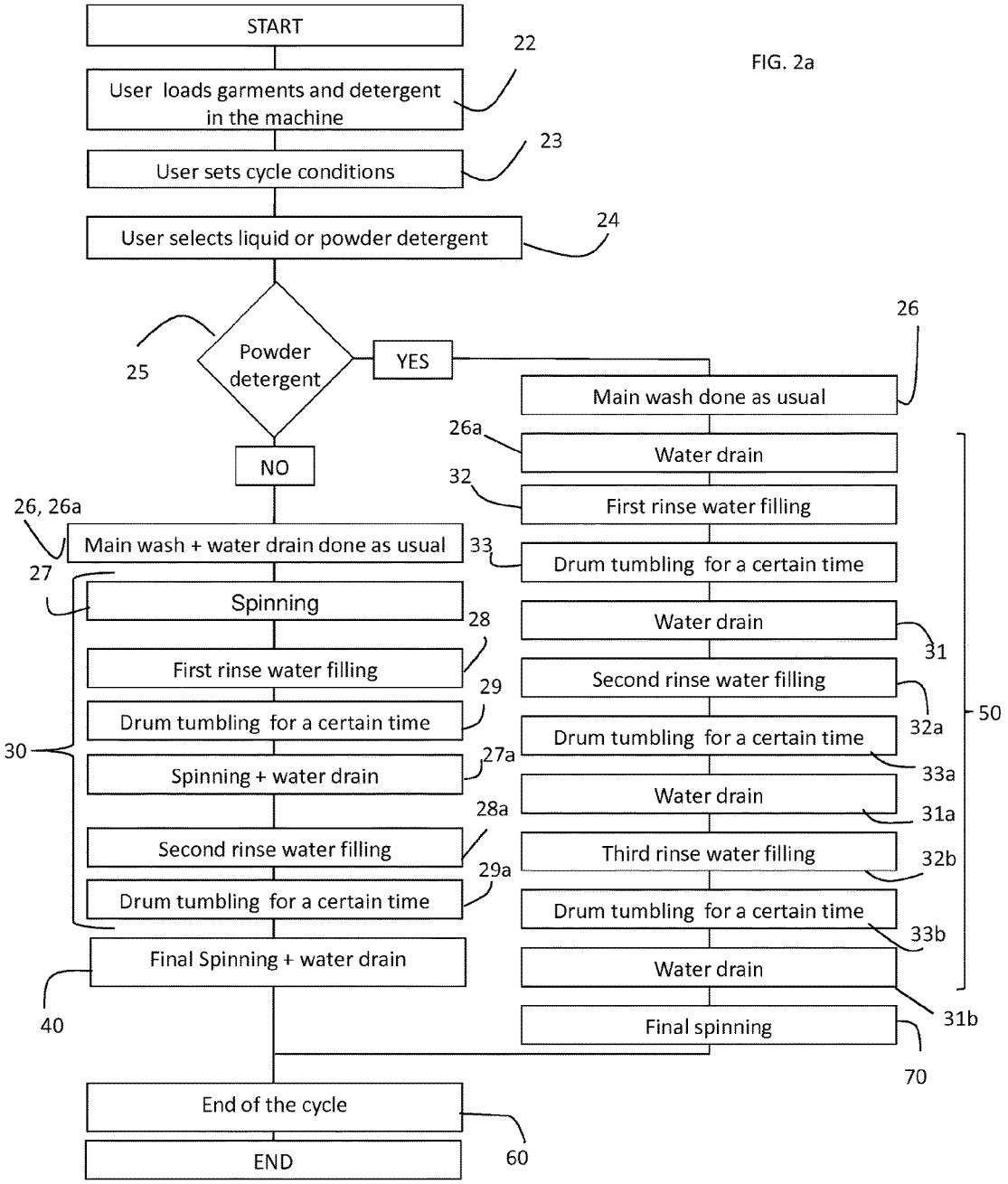
FIG. 2*a* is a flowchart of the method of the invention according to a first alternative.
Figure 2B:
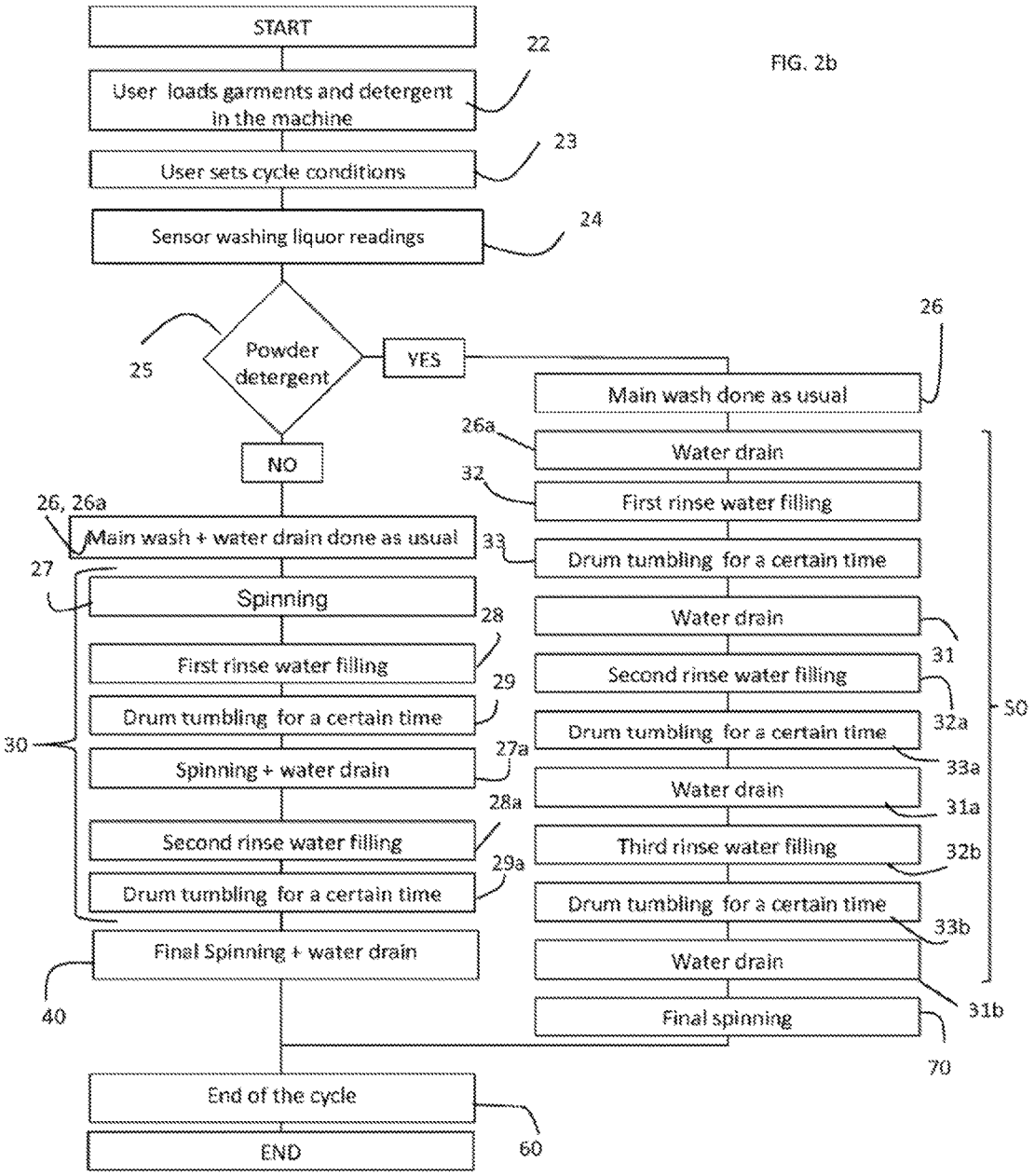
FIG. 2*b* is a flowchart of the method of the invention according to a variant of the first alternative of FIG. 2*a;*
Figure 3A:
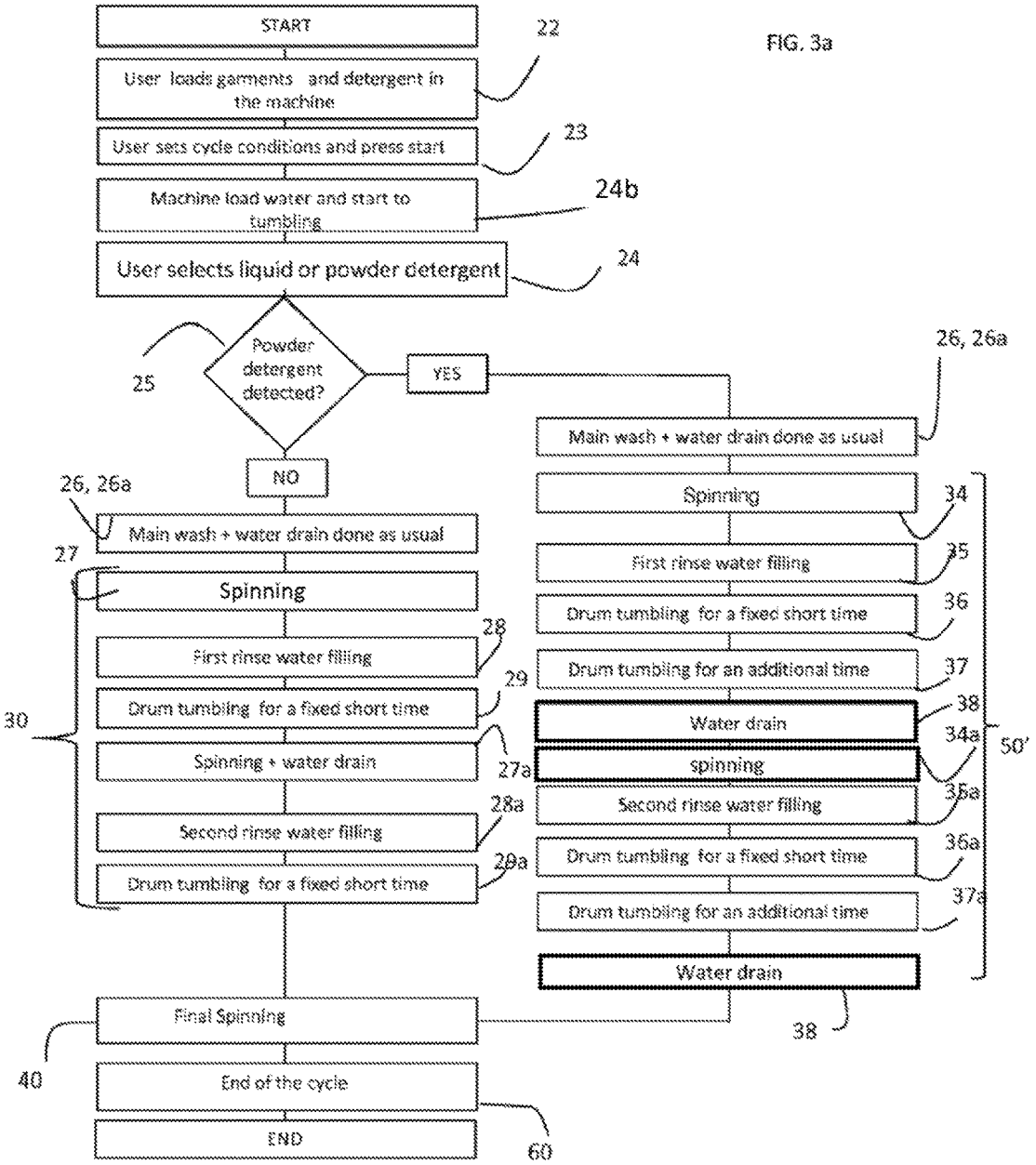
FIG. 3*a* is a flowchart of the method of the invention according to a second alternative.
Figure 3B:
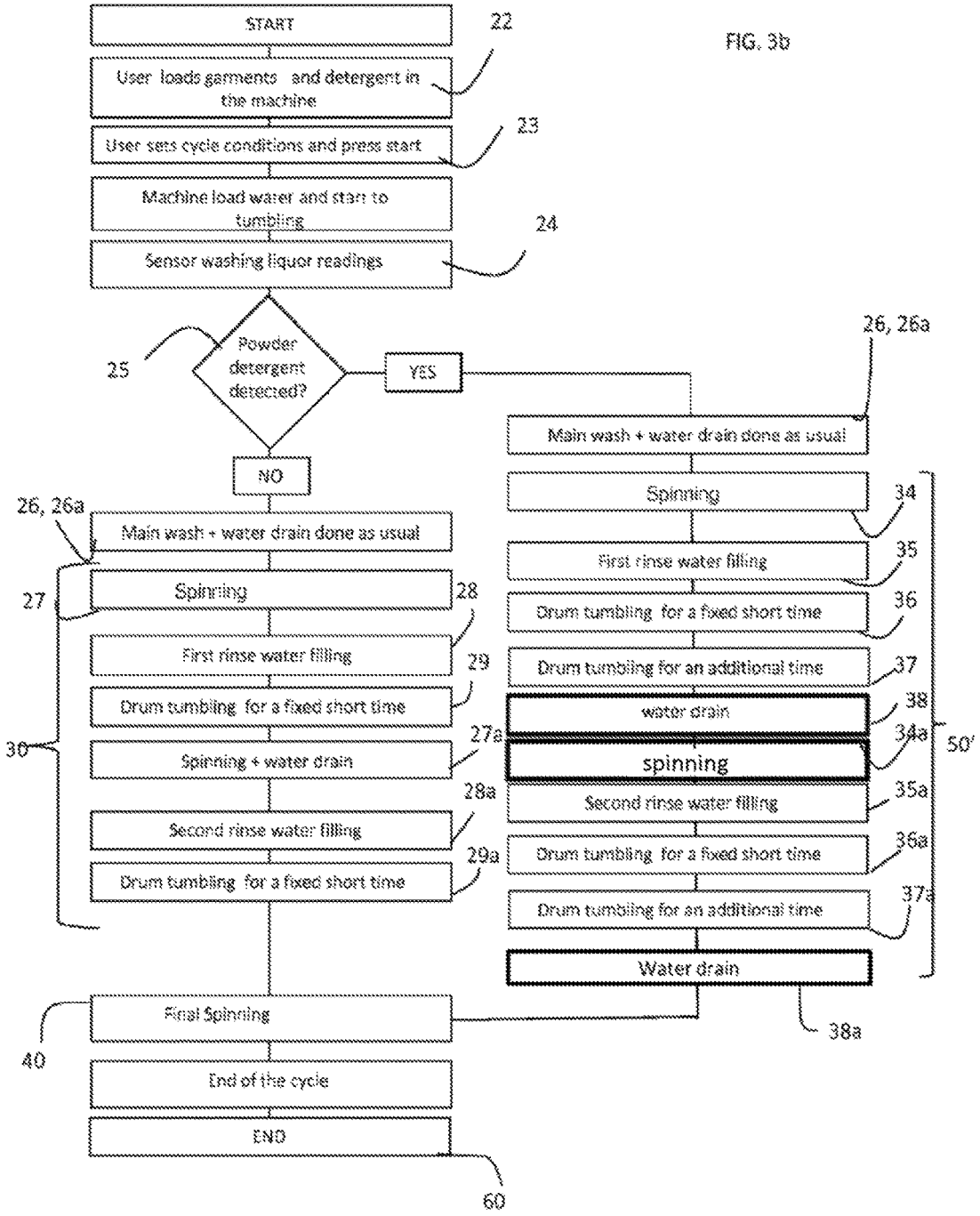
FIG. 3*b* is a flowchart of the method of the invention according to a variant of the second alternative of FIG. 3*a;*

In FIGS. 2*a* and 3*a*, in phase 24 the method of the invention includes a determination of the detergent's type by the user's input, e.g. the user selects the type of detergent introduced. In FIGS. 2*b* and 3*b*, phase 24 includes an automatic determination of the detergent's type by the machine 1 via suitable sensor(s) 20.

In dependency of such determination, the method of the invention selects and adjusts the further rinsing cycle. It is checked in phase 25 whether the detergent is of a first type, e.g. it is a powder detergent.

Regardless whether the detergent is of the first type, preferably the wash cycle of the wash program (phase 26, labelled with the same reference number both in case of a liquid and of a powder detergent) remain unchanged and it is performed according to the selected washing program, in other words only the rinsing cycle is modified according to the type of detergent used. According to a different embodiment of the invention, not depicted in the drawings, the wash cycle in case of a liquid or gel detergent and the wash cycle in case of a powder detergent for the same selected program by the user can be different one from the other.

If the detergent is not of a first type, i.e. if the answer to the check of phase 25 is "no", for example the detergent is a detergent in a liquid form, no action is required in both wash and rinsing cycles, i.e. the rinsing cycle stays also unchanged according to the selected program by the user.

As depicted in all figures, in case of a liquid or gel detergent, the main wash cycle is performed, main wash which terminates with a water drain of the water liquor present into the washing chamber (phase 26*a*, main wash 26 and water drain of washing liquor 26*a* are depicted as a single block in FIGS. 2*a*-2*b*, 3*a*-3*b* and 4).

The rinsing cycle 30 performed when such a liquid or gel detergent is introduced in the washing machine 1, as shown in all FIGS. 2*a*-2*b*, 3*a*-3*b* and 4, includes a first rinsing step. The first rinsing step comprises an initial spinning phase 27 where the washing liquor is still drained due to the fact that some liquor may have remained after the draining 26*a* of the main wash cycle, and then includes a first fresh water intake 28 of clean water and a tumbling phase 29 in which the laundry is tumbled for a time interval T1. Additional rinsing phases might be present as well, the number of which is preferably determined for example by the weight of the laundry and/or the type of the selected washing program and/or the amount of detergent introduced. Each further rinsing step includes preferably a further water intake, tumbling of the laundry and drain of water. It might include additional phases, such as a spinning. In particular, preferably after a drain of water of a precedent rinsing step and before a water intake of the subsequent rinsing step, a spinning phase is performed, as shown in all drawings 2*a*-2*b*, 3*a*-3*b* and 4. In the preferred embodiments of FIGS. 2*a*-2*b*, 3*a*-3*b* and 4 the rinsing cycle 30 includes two rinsing steps, the first rinsing step including phases 28 29, and 27*a* and the second rinsing step including a second fresh water intake 28*a* of clean water, and a second tumbling phase 29*a* in which the laundry is tumbled for a time interval T2. Preferably the tumbling time T1 and T2 of the first and second tumbling step is the same.

First and second rinsing step are preferably separated by a draining phase and a spinning step 27*a* so that between two different water intakes of two different rinsing steps the already used rinsing liquor is discharged. A different number of rinsing steps might be present as well; preferably two consecutive rinsing steps are separated by the draining step and a spinning step, the first belonging to the first of the two, and the second to the second of the two.

In other words, given the N-rinsing step including: N-water intake, N-tumbling and N-draining, the N+1 rising step including N+1-water intake, N+1 tumbling and N+1 draining, between the N-draining and the N+1 water intake a spinning is performed.

At the end of the rinsing cycle 30 in case of a liquid or gel detergent, according to a preferred embodiment of the invention as depicted in FIGS. 2*a*-2*b*, 3*a*-3*b*, 4 *a* final spinning cycle 40 takes place. The spinning cycle 40 can be a single cycle, i.e. the washing chamber rotates at a speed always higher than the minimum spinning speed for a given time interval, or it is divided in separated spinning steps, the washing chamber accelerating above the minimum spinning speed and then decelerating below the latter, returning to tumbling speed, more than once in the spinning cycle.

After the spinning cycle 40, according to an embodiment of the invention, the wash program ends (phase 60). However, for example in case of a washer-dryer, additional cycles can be present as well, such as a drying cycle (not depicted in the appended drawings).

Alternatively, if the detected detergent is a powder detergent, so that the answer to phase 25 is "yes", then action is taken by the appliance 1 according to a command of the control unit 16.

Figure 4:
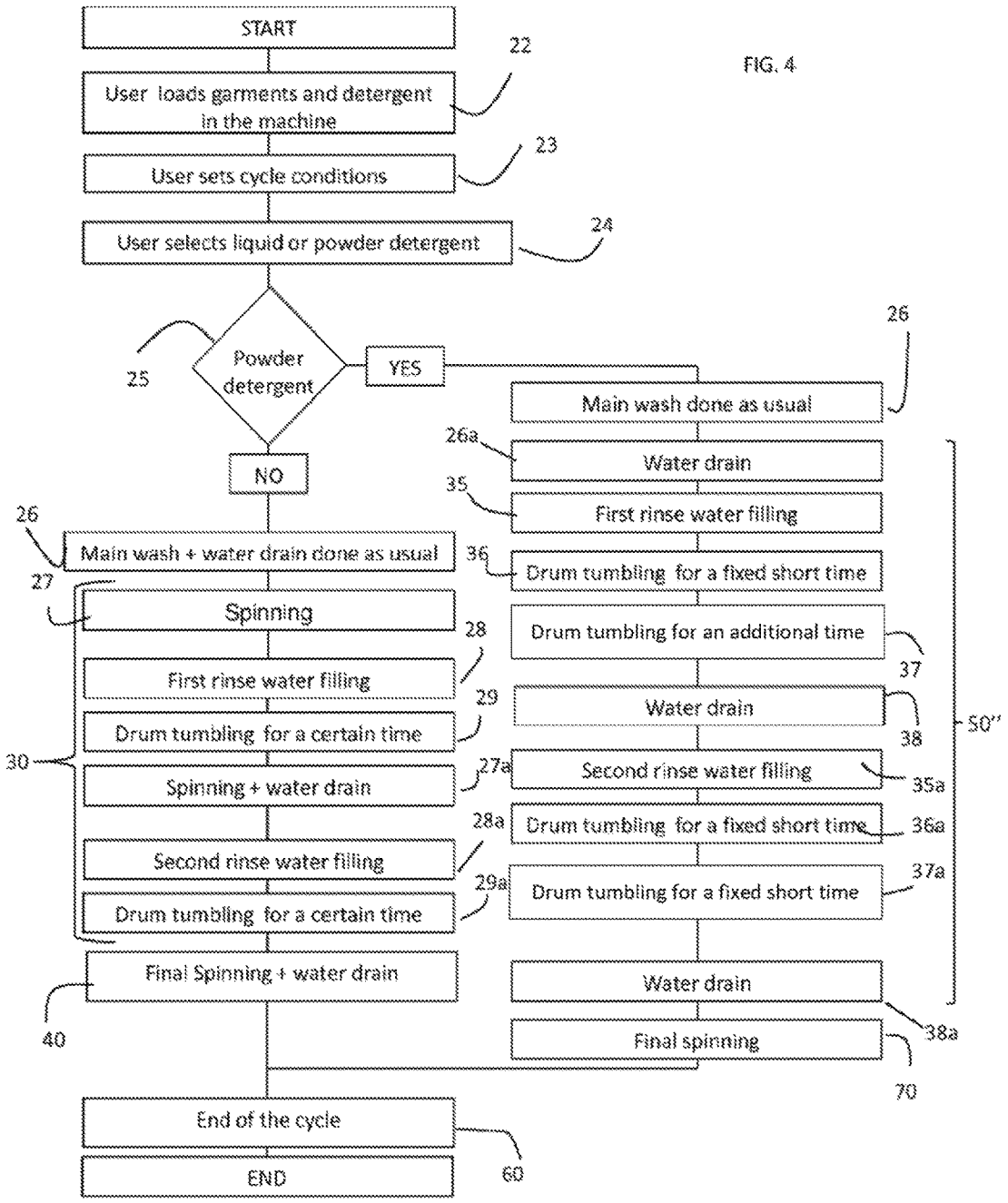
FIG. 4 is a flowchart of the method of the invention according to a third alternative.

As depicted in the appended FIGS. 2*a*-2*b*, 3*a*-3*b* and 4, after an unmodified wash cycle 26 according to the selected program, which also ends with a washing liquor drain 26*a*, this "action" phase includes a rinsing cycle 50, 50', 50" performed after the wash cycle 26 and washing liquor drain 26*a*, which comprises either:

A. Avoiding any spinning during the period between the washing liquor drain and the first water intake in the rinsing cycle 50, which means that during this period of the rinsing cycle 50 when a powder detergent is detected the rotational speed of the washing chamber is always kept below the minimum spinning speed, in other words the laundry is always tumbled (this embodiment of the invention is depicted in FIGS. 2*a*, 2*b* and 4); or B. During the rinsing cycle 50', increasing the tumbling time with respect to the tumbling time T1 and/or T2 during which the laundry is tumbled in case of liquid or gel detergent (this embodiment of the invention is depicted in FIGS. 3*a*, 3*b* and 4); or C. Both B and A applies, in other word during the rinsing cycle 50" spinning is avoided between the washing liquor drain and the first water intake and the tumbling time is increased (this embodiment is depicted in FIG. 4).

In all embodiments of the invention, the rinsing cycle 50, 50', 50" may be divided in different steps, including more than one rinsing step. Each rinsing step includes water intake, tumbling of the laundry and drain of water. It might include additional steps, such as a spinning.

With now reference to FIGS. 2*a* and 2*b*, depicting embodiment A, the rinsing cycle 50 includes a first rinsing step having a rinse water filling 32, a tumbling phase 33 and a first draining phase 31. The duration T3 of the tumbling 33 can be equal to or different from the duration T1, or T2 of the tumbling phases 29, 29*a* in rinsing cycle 30 in case of a liquid or gel detergent.

More preferably, the rinsing cycle 50 further includes a second rinsing step having a second rinse water filling 32*a*, a second tumbling phase 33*a* and a second draining phase 31*a*. The second tumbling phase 33*a* lasts for a time interval T4 which might be equal or different to T3, preferably being identical to T3. Even more preferably, the rinsing cycle 50 includes a third rinsing step having a third rinse water filling 32*b*, a third tumbling phase 33*b* and a third draining phase 31*b*. The third tumbling phase 33*b* lasts for a time interval T5 which might be equal or different to T3 and/or T4, preferably being identical to T3 and/or T4.

Preferably, also between the first draining phase 31 and the second water intake 32*a* as well as between the second draining phase 31*a* and the third water intake 32*b*, no spinning is performed. In general, preferably between the N-draining phase of the N-rinsing step and the N+1 water intake of the N+1 rinsing step, in this embodiment of the invention no spinning is performed, so that the laundry is always tumbled at a revolving speed lower than the minimum spinning speed.

The rinsing cycle 50 in case powder detergent is detected preferably includes an extra rinsing step with respect to the number of rinsing steps present in the rinsing cycle 30 in case the liquid or gel detergent is detected.

In the depicted embodiments of FIGS. 2*a* and 2*b*, the rinsing steps in case of a liquid or gel detergent are two, while the rising steps in case of a powder detergent are three.

Preferably, the number of rinsing steps in case of a powder detergent is equal to the number of steps in case of a liquid or gel detergent plus 1.

Optionally, the rinsing cycle 50 is ended by a final spinning cycle 70, the characteristics of which are preferably similar or identical to the final spinning cycle 40 which ends the rinsing cycle 30 in case the liquid or gel detergent is detected. However, a different final spinning cycle 70 can be envisaged as well. During the spinning 70, a further draining can be performed.

With now reference to FIGS. 3*a* and 3*b*, embodiment B of the invention is depicted. The difference between the method depicted in FIG. 3*a* and the one depicted in FIG. 3*b* lies in the manual (3*a*) or automatic (3*b*) detection of the type of detergent in phase 24.

Moreover, the depicted embodiment in FIGS. 3*a*, 3*b* clarifies that the detecting phase 24 in which the type of detergent is recognized can be performed at any moment in time before the rinsing cycle 50, 50'. Indeed, as visible, a "machine load water and start to tumble" phase 24*b* is shown, which is part of the washing cycle 26. Thus in this embodiment, the detection of the type of detergent is done during the wash cycle 26, after water has been introduced inside the washing chamber 2.

Steps 22-26*a* as well as the rinsing cycle 30 in case of a liquid or gel detergent in this embodiment B are the same as in the previous A embodiment, therefore the same reference numerals have been used and, for their explanation, reference is made to the description above made of FIGS. 2*a* and 2*b*.

In this embodiment B, main wash 26 and washing liquor drain 26*a* in case of the powder detergent are performed as usual as in embodiment A. Furthermore, in order to optimize the rinsing cycle 50' in case of powder detergent, the rinsing cycle 50' includes a first rinsing step comprising a first spinning step 34 where the draining of the wash liquor takes place, a first filling of water 35 in order to perform the rinsing, a first tumbling of the laundry for a fixed time 36 and then a tumbling for an additional time 37, ended by a first water drain 38. The steps of tumbling for a fixed time and for an additional time could be combined into a single long tumbling phase. The total tumbling time T6 of steps 36 and 37 is longer than the tumbling during a rinsing step of the rinsing cycle 30 in case of a liquid or gel detergent. In other words, T6>T1 and T6>T2. For example, T6=T1 (T2)+T extra. Thus the first tumbling for a fixed time 36 is the same as the tumbling in case of a liquid detergent, and then an extra tumbling time is added in the tumbling for additional time phase 37.

Preferably, the rinsing cycle 50' includes a second rinsing step having a second spinning phase 34*a*, a second rinse water filling 35*a*, a second tumbling phase 36*a*, 37*a*, the total time T7 of which is longer than T1 and T2, and a second water drain 38*a*. Preferably T6=T7, e.g. the duration of all tumbling phases in the same rinsing cycle 50' is the same.

However what matter is that the total tumbling time of all tumbling steps of the rinsing cycle in case of a powder detergent is longer than the total tumbling time of all tumbling steps in case of a liquid or gel detergent. In other words:

$$T6+T7>T1+T2$$

Regardless of the specific relation between T6 and T1, T2 or T7 and T1, T2 (it could well be that T6<T1 or T2 if the above equation still holds).

In addition, the number of rinsing steps in case of a liquid detergent can be different than the number of rinsing steps in case of a powder detergent, so for example there is a single tumbling time T1 in case of a liquid or gel detergent and more tumbling times in case of a powder detergent, so that the equation becomes $$T6+T7>T1$$

And in this case both T6 and T7 could be smaller than T1.

In this embodiment, between the draining phase of a rinsing step and the water intake of the subsequent rinsing step, spinning is performed. The rinsing cycle is optimized tumbling the laundry longer than in case of a liquid or gel detergent.

Optionally, the rinsing cycle 50' is followed by a final spinning cycle 40, the characteristics of which are preferably similar or identical to the final spinning cycle 40 which ends the rinsing cycle 30 in case the liquid or gel detergent is detected. However, a different spinning cycle can be envisaged as well.

The rinsing cycle 50' may, according to a non-depicted embodiment, include a third rinsing step having a third spinning step, a third rinse water filling and a third tumbling step having a duration T8, so that T6+T7+T8 is longer than T1+T2.

The invention also encompass a solution in which embodiment A of FIGS. 2*a* and 2*b* and embodiment B of FIGS. 3*a* and 3*b* are merged, so that in case powder detergent is detected, no spinning is performed between the washing liquor drain and the first water intake and also a longer tumbling (with a duration longer than the duration of the tumbling in the rinsing cycle 30 performed in case of a liquid or gel detergent) is present. This solution is depicted in FIG. 4.

Although FIG. 4 depicts lies in the manual detection of the type of detergent in phase 24, an automatic detection of the detergent can be performed as well, in an analogous manner of the above depicted embodiments.

Steps 22-26*a* as well as the rinsing cycle 30 in case of a liquid or gel detergent in this embodiment C are the same as in the previous A & B embodiments, therefore the same reference numerals have been used and, for their explanation, reference is made to the description above made of FIGS. 2*a*, 2*b*, 3*a* and 3*b*.

Thus the rinsing cycle 50" of this embodiment includes, after the washing liquor drain 26*a*, a first rinsing step including a first water intake 35, a first tumbling 36 and 37 and a first water drain 38. Between the washing liquor drain 26*a* and the first water intake 35, no spinning is performed, as per the embodiments of FIGS. 2*a* and 2*b*. Moreover, the first tumbling phase a first tumbling of the laundry for a fixed time 36 and then a tumbling for an additional time 37. The steps of tumbling for a fixed time and for an additional time could be combined into a single long tumbling phase. The total tumbling time T6 of steps 36 and 37 is longer than the tumbling during a rinsing step of the rinsing cycle 30 in case of a liquid or gel detergent. In other words, T6>T1 and T6>T2. For example, T6=T1 (T2)+T extra. Thus the first tumbling for a fixed time 36 is the same as the tumbling in case of a liquid detergent, and then an extra tumbling time is added in the tumbling for additional time phase 37.

Preferably, the rinsing cycle 50" includes a second rinsing step having a second rinse water filling 35*a* and a second tumbling phase 36*a*, 37*a*, the total time T7 of which is longer than T1 and T2. Preferably T6=T7, e.g. the duration of all tumbling phases in the same rinsing cycle 50' is the same. The second rising step is terminated by a water drain 38*a*. Preferably, between the first water drain 38 and the second water intake 35*a* no spinning is performed.

Also in this embodiment, what matter is that the total tumbling time of all tumbling steps of the rinsing cycle in case of a powder detergent is longer than the total tumbling time of all tumbling steps in case of a liquid or gel detergent. In other words:

$$T6+T7>T1+T2$$

Regardless of the specific relation between T6 and T1, T2 or T7 and T1, T2 (it could well be that T6<T1 or T2 if the above equation still holds).

In addition, the number of rinsing steps in case of a liquid detergent can be different than the number of rinsing steps in case of a powder detergent, so for example there is a single tumbling time T1 in case of a liquid or gel detergent and more tumbling times in case of a powder detergent, so that the equation becomes $$T6+T7>T1$$

And in this case both T6 and T7 could be smaller than T1.

Optionally, the rinsing cycle 50" is followed by a final spinning cycle 70, the characteristics of which are preferably similar or identical to the final spinning cycle 40 which ends the rinsing cycle 30 in case the liquid or gel detergent is detected. However, a different spinning cycle can be envisaged as well.

Preferably, the rinsing cycle 50" also includes an extra rinsing step with respect to the number of rinsing steps present in the rinsing cycle 30 in case the liquid or gel detergent is detected.

Preferably, the number of rinsing steps in case of a powder detergent is equal to the number of steps in case of a liquid or gel detergent plus 1.

The duration and the number of tumbling phases both in rinsing cycle 50, 50' and 50" with a powder detergent may also depend on the amount of detergent introduced and/or on the weight of the laundry. Preferably, also the duration and the number of tumbling phases in rinsing cycle 30 with a liquid or gel detergent may also depend on the amount of detergent introduced and/or on the weight of the laundry. The invention allows optimizing the duration and the water usage during the rinsing cycle according to the type of detergent detected.

The invention claimed is:

1. A method for controlling a wash process in a washing appliance having a washing chamber to wash laundry, comprising:

receiving a detergent in said washing appliance;

detecting a detergent received in the washing appliance;

determining whether the detected detergent is a powder detergent, a liquid detergent, or a gel detergent;

performing a wash cycle, said wash cycle ending with a washing liquor drain;

selecting a rinsing cycle from among a predetermined set of different rinsing cycles in accordance with the determined type of detergent;

upon determining the detected detergent is the powder detergent:

performing a first rinsing cycle from the selected rinsing cycle, said first rinsing cycle comprising:

after said washing liquor drain of the washing cycle, introducing water into said washing chamber for a first rinsing step;

tumbling laundry in said washing chamber at at least one of a revolving speed lower than a minimum spinning speed, which is a speed at which the laundry remains attached to an inner wall of said washing chamber, so that no spinning is performed between said washing liquor drain of the washing cycle and said introducing water in the first rinsing step of the rinsing cycle when the determined detergent is the powder; and tumbling said laundry for a time interval during the first rinsing cycle when the determined detergent is the powder detergent that is different from a corresponding time interval during which the laundry is tumbled in a rinsing cycle performed when the determined type of detergent is the liquid detergent or the gel detergent; and upon determining the detected detergent is the liquid detergent or the gel detergent:

performing a rinsing cycle having at least two rinsing steps, wherein a spinning is performed between said washing liquor drain and introducing water into the washing chamber for a first rinsing step of the at least two rinsing steps when the determined is the liquid detergent or the gel detergent.

2. The method according to claim 1, wherein the tumbling said laundry for a time interval different from the corresponding time interval during which the laundry is tumbled in the rinsing cycle when the liquid or gel detergent is determined includes tumbling said laundry when the determined detergent is the powder detergent for a time interval longer than the corresponding time interval during which the laundry is tumbled in the rinsing cycle performed when the determined detergent is the liquid or gel detergent.

3. The method according to claim 1, including, in said rinsing cycle:

tumbling said laundry for a time interval dependent on the amount of said detected detergent.

4. The method according to claim 1, including:

terminating said wash process with a final spinning cycle after said rinsing cycle.

5. The method according to claim 1, further comprising when said determined detergent is the powder detergent, providing more than one rinsing step during said selected rinsing cycle.

6. The method according to claim 5, wherein, when said determined detergent is the powder detergent, and said selected rinsing cycle includes at least two rinsing steps, said first rinsing step including a first draining phase, and said second rinsing step including a second water intake, the selected rinsing cycle further including:

tumbling laundry in said washing chamber always at a revolving speed lower than a minimum spinning speed, which is the speed at which the laundry remains attached to an inner wall of said washing chamber, so that no spinning is performed between said first draining phase and said second water intake.

7. The method according to claim 6, wherein, when said determined detergent is the powder detergent, and said selected rinsing cycle includes at least three rinsing steps, said second rising step including a second draining phase and a third rinsing step including a third water intake, the selected rinsing cycle further including:

between said second water draining phase and said third water intake, tumbling laundry in said washing chamber always at a revolving speed lower than a minimum spinning speed, which is the speed at which the laundry remains attached to an inner wall of said washing chamber, so that no spinning is performed between said second water draining phase and said third water Intake.

8. The method according to claim 1, wherein, the performing the first rinsing cycle from the determined set of different rinsing cycles when the type of said determined detergent is the powder detergent, further comprises, adding a further rinsing step to a number of rinsing steps present in a rinsing cycle performed when the determined detergent is the liquid detergent or the gel detergent.

9. The method according to claim 1, wherein tumbling said laundry for a time interval different from the corresponding time interval during which the laundry is tumbled in rinsing cycle where the liquid detergent or the gel detergent is detected includes:

separating said rinsing cycle in different rinsing steps; and providing a spinning step between two consecutive rinsing steps.

10. The method according to claim 1, wherein determining the type of detergent received in the washing appliance includes:

determining the conductivity of a wash liquor during said wash cycle; and/or determining the turbidity of a wash liquor during said wash cycle.

11. The method according to claim 10, wherein said measuring the conductivity of the washing liquid includes:

determining the rate of change in conductivity caused by dissolution of said detergent in said washing liquid.

12. The method according to claim 10, wherein measuring the turbidity of a washing liquid present in said washing chamber includes:

determining the rate of change in turbidity caused by dissolution of said detergent in said washing liquid.

13. The method according to claim 10, wherein determining the type of said detergent includes:

measuring the conductivity of a washing liquid present in said washing chamber; and measuring the turbidity of a washing liquid present in said washing chamber; and determining that said detergent is the liquid detergent or the gel detergent when said conductivity is below a conductivity threshold and said turbidity is below a turbidity threshold; or determining that said detergent is the powder detergent when said conductivity is above a conductivity threshold and said turbidity is above a turbidity threshold.

14. The method according to claim 1, wherein determining the type of detergent received in said washing appliance includes:

inputting by the user the type of detergent introduced.

15. The method according to claim 1, wherein detecting the detergent received in said washing appliance includes:

determining whether said detergent received is the powder detergent, or the liquid or gel detergent, or a liquid pod detergent, or a powder tab detergent.

16. The method according to claim 1, further including:

setting a duration of said rinsing cycle on the basis of the weight of the laundry and/or a type of washing program selected by the user.

17. The method according to claim 1, further comprising when said detergent type cannot be detected, setting said detergent type equal to the powder detergent.

18. The method according to claim 1, further comprising:

after said washing liquor drain of the washing cycle, introducing water into said washing chamber for a first rinsing step, tumbling the laundry in said washing chamber always at a revolving speed lower than a minimum spinning speed, which is the speed at which the laundry remains attached to an inner wall of said washing chamber, so that no spinning is performed between said washing liquor drain and said first water intake; and tumbling said laundry for a time interval different from the corresponding time interval during which the laundry is tumbled in a rinsing cycle performed when the determined type of detergent is the liquid detergent or the gel detergent.

* * * * *